United States Patent [19]

Gutierrez

[11] 3,996,705

[45] Dec. 14, 1976

[54] WALL FACING HAVING V-SHAPED CHANNEL-LIKE FOLDS

[76] Inventor: William D. Gutierrez, 2046 Via Verde, Covina, Calif. 91724

[22] Filed: Feb. 3, 1975

[21] Appl. No.: 546,203

[52] U.S. Cl. ..... 52/71; 52/35; 160/231 A

[51] Int. Cl.[2] ..... E04C 2/32; E04B 2/72

[58] Field of Search ..... 160/230, 231 A; 52/71, 52/64, 34, 35, 460, 395, 400, 403, 615; 16/DIG. 13; 52/631

[56] References Cited

UNITED STATES PATENTS

| | | | |
|---|---|---|---|
| 503,426 | 8/1893 | Knower | 52/395 |
| 1,711,471 | 4/1929 | Curran | 52/631 |
| 2,677,268 | 5/1954 | Hobbs | 52/395 X |
| 3,131,753 | 5/1964 | Dixon | 160/231 A |
| 3,158,237 | 11/1964 | Schooler | 52/35 |
| 3,232,333 | 2/1966 | Dixon | 160/231 A |
| 3,312,585 | 4/1967 | Hamme | 52/35 X |
| 3,326,268 | 6/1967 | Dixon | 160/231 A |
| 3,562,973 | 2/1971 | Gangemi | 52/35 X |
| 3,609,773 | 10/1971 | Mustee | 52/71 X |
| 3,649,398 | 3/1972 | Keith | 52/631 |
| 3,688,459 | 9/1972 | Mattix | 52/34 X |
| 3,845,600 | 11/1974 | Moore | 52/34 X |

FOREIGN PATENTS OR APPLICATIONS

| | | | |
|---|---|---|---|
| 698,538 | 11/1964 | Canada | 52/460 |
| 1,127,107 | 12/1956 | France | 160/231 A |
| 1,934,012 | 1/1971 | Germany | |
| 349,401 | 11/1960 | Switzerland | 52/400 |
| 1,232,580 | 5/1971 | United Kingdom | 16/DIG. 13 |

*Primary Examiner*—Price C. Faw, Jr.
*Assistant Examiner*—Leslie Braun
*Attorney, Agent, or Firm*—Boniard I. Brown

[57] ABSTRACT

A wall facing for use as a tub surround and other wall facing applications. The facing comprises a preformed relatively stiff though flexible facing sheet of formed plastic or other suitable material having two or more adjacent generally planar panel sections and a rearwardly projecting channel-like fold between and joining each pair of adjacent panel sections. Each fold has a rear flexible hinge portion about which the facing sheet may be bent to a folded configuration wherein the junctures of the fold wall with the adjacent panel sections abut and the adjacent panel sections are disposed in oblique angular relation to conform to a corner between two mounting wall surfaces. The junctures may be arcuately shaped to form a recess between the abutting junctures in the folded configuration of the facing sheet for receiving a filler or sealant material. Along the outer edges of the panel sections are rearwardly projecting flanges with outturned mounting lips along their rear edges which seat against the mounting wall surfaces and are secured to the wall surfaces by nails, screws, adhesive or the like.

6 Claims, 4 Drawing Figures

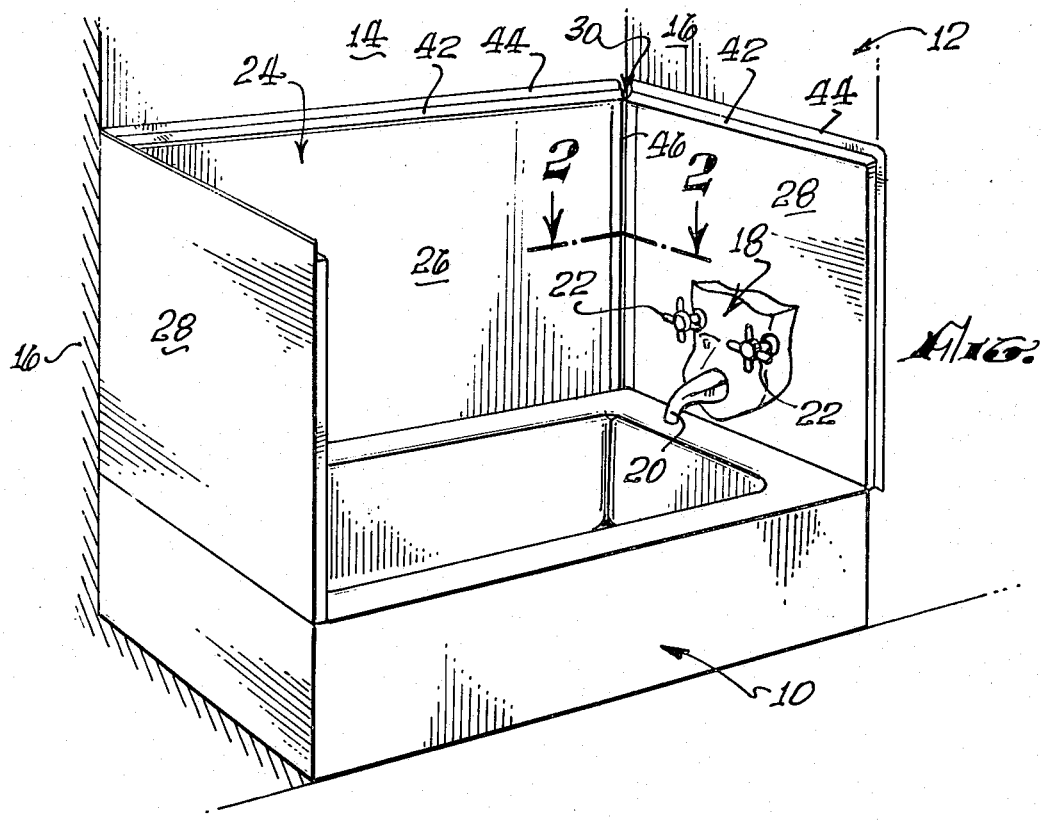
FIG. 1.
FIG. 2.
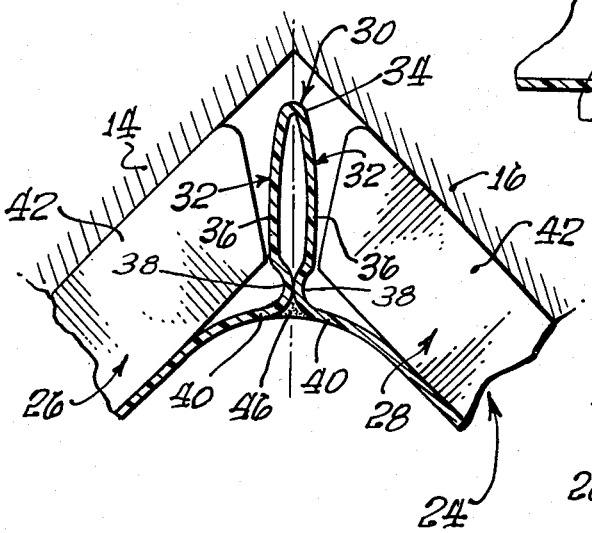
FIG. 3.
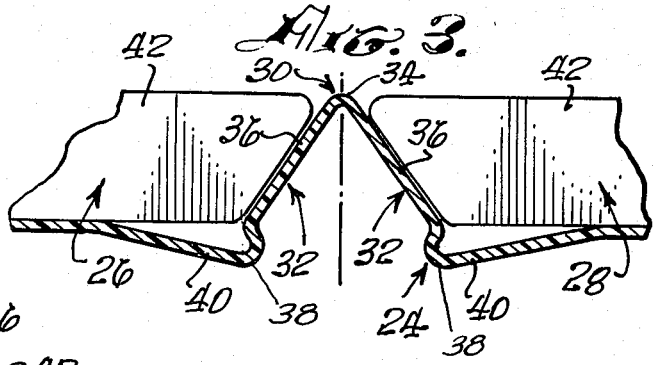
FIG. 4.
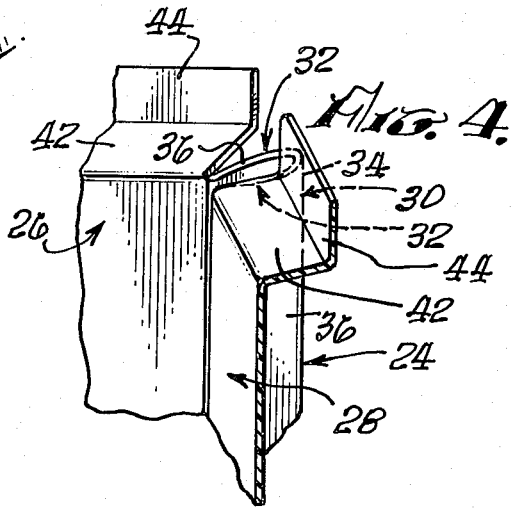

WALL FACING HAVING V-SHAPED CHANNEL-LIKE FOLDS

BACKGROUND OF THE INVENTION

1. Field of the Invention

This invention relates generally to building construction areas and more particularly to a novel wall facing.

2. Discussion of the Prior Art

A wall facing in the context of the present invention is a facing sheet for application over wall surfaces for decorative and/or protective purposes. The invention will be described in connection with wall facings for use as tub and shower surrounds, that is facing sheets to be applied to the walls of a bath tub or shower enclosure for both decorative and water sealing purposes. It will become readily evident as the description proceeds, however, that the wall facing of the invention is not limited to these particular uses.

Bath tub and shower installations constructed prior to the relatively recent introduction of preformed modular tub and shower units utilized tiled walls for the tub and shower enclosures and a bath tub formed separately from the tub enclosure walls. This type of tub and shower construction has several disadvantages. Thus, the corner joints between the enclosure walls, the joints between the individual wall tiles, and, in the case of a tub installation, the joints between the tub and tub enclosure walls must be periodically grouted or otherwise sealed to prevent water leakage. Improper sealing often results in water leakage. Moreover, the grouted joints tend to darken with use, thus rendering the enclosure walls, and particularly the joints, difficult to clean.

The preformed modular tub and shower units referred to above avoid these problems because of their one piece molded construction wich eliminates grouted joints and provides smooth easily cleanable enclosure walls. However, total replacement of a tiled tub or shower installation by a one piece modular unit is generally too costly to be practical.

SUMMARY OF THE INVENTION

According to its more limited aspects, this invention provides a wall facing which may be applied to tiled walls of an existing tub or shower installation to achieve most if not all of the advantages of a one piece performed modular unit. As noted earlier, it will become readily apparent as the description proceeds, however, the wall facing of the invention is not limited to these particular uses.

The wall facing of the invention comprises a relatively rigid though flexible performed facing sheet of formed or molded plastic or other suitable material and having a normally rear wall facing side and an opposite, normally front side. The facing sheet has at least two adjacent planar panel sections and a channel like fold between and integrally joining each pair of adjacent panel sections. Each fold has confronting side walls integrally joined to and projecting rearwardly in converging relation from the adjacent edges of the adjacent panel sections and integrally joining one another rearwardly of the panel sections to form a flexible hinge portion along the centerline of the fold. The facing sheet is bendable at the hinge portion of each fold to a folded configuration wherein the junctures of the fold side walls with the adjacent panel sections abut one another and the panel sections are disposed in oblique angular relation to conform to a corner formed by two facing sheet mounting walls. Along the outer edges of the panel sections are rearwardly extending flanges terminating in outturned mounting lips for seating against the mounting wall surfaces. The facing sheet is secured to the mounting walls by driving nails or screws through the lips or by bonding the lips to the walls.

The particular wall facing described is a tub surround having three panel sections and two intervening folds at which the sheet is adapted to be bent into a generally U-shape for application to the walls of a tub enclosure. The junctures of the fold side walls with the adjacent panel sections and the adjacent edge portions of these sections are shaped to form curved corners between the panel sections when the facing sheet is bent for application to the tub enclosure walls. The abutting junctures define shallow and narrow seam-like grooves or recesses for receiving grout or other sealant for sealing the corners against water leakage into the folds. The lower edges of the facing sheet are sealed to the tub.

BRIEF DESCRIPTION OF THE DRAWINGS

FIG. 1 is a perspective view of a wall facing according to the invention used as a tub surround and installed within a bath tub enclosure;

FIG. 2 is an enlarged section through one corner of the facing sheet or tub surround taken on line 2—2 in FIG. 1;

FIG. 3 shows the wall facing structure of FIG. 2 prior to bending; and

FIG. 4 is a perspective of the facing sheet structure of FIGS. 2 and 3 during bending.

DESCRIPTION OF THE PREFERRED EMBODIMENT

Referring first to FIG. 1, the illustrated bath tub installation comprises a bath tub 10 proper and a tub enclosure 12. Enclosure 12 has a wall 14 along the rear side of the tube and walls 16 at the ends of the tub. The enclosure is thus walled on three sides and is open at its front side to provide access to the tub 10. One end wall 16 mounts a faucet 18 having a spout 20 and hot and cold water handles 22.

Installed within the tub enclosure 12 is a preformed wall facing or tub surround 24 according to the invention. Wall facing 24 is formed or molded from a relatively stiff though flexible material such as a suitable plastic. The facing may be fabricated, for example, by heat forming a plastic sheet.

Wall facing 24, when initially performed, is essentially flat and is thereafter folded to its illustrated generally U-configuration in the manner explained below. The wall facing comprises a facing sheet having three generally planar panel sections 26, 28 of rectangular outline arranged end to end and a generally channel-like fold 30 between and integrally joining each pair of adjacent panel sections. The longer panel section 26 has substantially the same length as the tub 10. The two shorter panel sections 28 have a length substantially equal to the width of the tub.

Turning to FIGS. 2–4, each facing sheet fold 30 has confronting side walls 32 integrally joined to and extending rearwardly in converging relation from the adjacent edges of the adjacent panel sections 26, 28. The side walls are integrally joined along their rear edges rearwardly of the panel sections to form a hinge portion 34 along the centerline of the fold at which the facing sheet may be bent to a folded configuration, as described below. In the particular embodiment shown, the folds 30 have a generally V-cross-section and their walls have rear planar portions 36 which converge and join to form the hinge portion 34. The forward junctures 38 of the walls 32 of each fold 30 with the adjacent panel sections 26, 28 are arcuate in cross-section and bow or arch inwardly toward one another beyond the inner surfaces of the planar wall portions 36, as shown in FIGS. 2 and 3. As explained below, these junctures abut when the facing sheet is folded.

According to a feature of the invention, the adjacent edge portions 40 of the adjacent panel sections 26, 28 slope outwardly or forwardly from the planes of the panel sections proper, shown in FIG. 3. The reason for this slope of the edge portions will be explained presently.

Along the outer edges of the facing sheet panel sections 26, 28, that is the edges of these sections which coincide with the four edges of the facing sheet 24 proper, are rearwardly extending flanges 42. Along the rear edges of these flanges are outturned mounting lips 44. Flanges 42 are separated from the sloping edge portions 40 of the panel sections.

The facing sheet 24 is intially preformed, to an essentially flat configuration wherein the adjacent panel sections 26, 28 and intervening folds 30 assume the positions and shapes illustrated in FIG. 3. The facing sheet is conditioned for installation by folding or bending the sheet at the hinge portions 34 of the folds 30. The sheet is bent at each hinge portion to a folded configuration (FIG. 2) wherein the fold junctures 38 abut and the adjacent panel sections 26, 28 are disposed in oblique angular relation to conform to a corner formed by two facing sheet mounting walls. In the case of the particular wall facing or tub surround shown, the two panel sections 28 are folded or bent at right angles to the panel section 26. The folded facing sheet is then placed within the tub enclosures 12 with its mounting lips 44 seating against the enclosure walls 14, 16 and is secured to the walls by driving nails or screws through the lips or bonding the lips to the walls. It will be understood, of course, that the facing sheet and its panel sections are sized to fit in the enclosure.

Referring to FIG. 2, it will be seen that when the facing sheet 24 is bent at each fold 30 to its folded configuration, the adjacent sloping panel section edge portions 40 bow to form a curved corner which may be easily cleaned. The abutting arcuate junctures 38 form a narrow and shallow seam like recess 46 along the fold which may be filled with grout or other sealant, as shown, to seal the corner against entrance of water into the fold. The lower edge of the installed facing sheet is sealed by grout or other sealant to the rear and end surfaces of the tub 10.

As shown in FIG. 1, the front end panel section 26 of the facing sheet 24 is apertured to receive the faucet spout 20 and handles 22. If desired, this panel section, as well as either or both of the remaining panel sections, may be embossed with decorative formations.

The inventor claims:

1. A wall facing comprising:

a relatively stiff though flexible facing sheet having normally front and rear sides and a rearwardly reentrant generally V-shaped channel-like fold extending from one edge to the opposite edge of the sheet and defining at opposite sides of the fold a pair of adjacent panel sections, each fold having confronting side walls formed by portions of said sheet and integrally joined to and projecting rearwardly in converging relation from the adjacent edges of the adjacent panel sections and integrally joining one another rearwardly of said panel sections to form a flexible hinge portion along the centerline of the fold at which said facing sheet may be bent to a folded configuration wherein the junctures of each fold side walls with the adjacent panel sections abut one another and the adjacent panel sections are disposed in substantially mutually perpendicular relation to conform to a corner formed by two facing sheet mounting walls, said facing sheet having a substantially uniform thickness throughout said panel sections and each fold, each panel section having outer edges along the edges of said facing sheet and integral rearwardly extending mounting flanges along said outer edges for seating against the mounting wall surfaces, the adjacent edge portions of each pair of adjacent panel sections sloping forwardly at a small angle from the planes of the sections as said edge portions approach the intervening fold, and said sloping edge portions being devoid of said mounting flanges and said junctures of the walls of each fold and the adjacent panel sections being arcuate in cross-section and arching toward one another beyond the fold side walls whereby said edge portions bend to an arcuate configuration and said junctures abut to form a forwardly opening recess along the fold for receiving a sealant such as grout when said facing sheet is bent to said folded configuration.

2. A wall facing according to claim 1 wherein: said facing sheet comprises a molded plastic sheet.

3. A wall facing according to claim 2 wherein: said facing sheet comprises a tub or shower surround having three panel sections and two folds.

4. A wall facing comprising:

a relatively stiff though flexible facing sheet having normally front and rear sides and a rearwardly reentrant fold extending from one edge to the opposite edge of the sheet and defining at opposite sides of the fold a pair of adjacent panel sections, each fold having confronting side walls formed by portions of said sheet and intergrally joined to and projecting rearwardly from the adjacent edges of the adjacent panel sections and integrally joining one another rearwardly of said panel sections to form a flexible hinge portion along the centerline of the fold, the adjacent panel sections being disposed in substantially mutually perpendicular relation with the junctures of the respective panel sections and the intervening fold side walls abutting one another to conform to a corner formed by two facing sheet mounting walls, said facing sheet having a substantially uniform thickness throughout said panel sections and each fold, each panel section having outer edges along the edges of said facing sheet and integral rearwardly extending mounting flanges along said outer edges for seating against the mounting wall surfaces, the adjacent edge portions of each pair of adjacent panel sections being devoid of said mounting flanges and conforming to a forwardly concave curvature, and the abutting junctures of the walls of each fold and the adjacent panel sections being arcuate in cross-section and arching toward one another to form a forwardly opening recess along the fold for receiving a sealant such as grout.

5. A wall facing according to claim 4 wherein: said facing sheet comprises a molded plastic sheet.

6. A wall facing according to claim 5 wherein: said facing sheet comprises a tub or shower surround having three panel sections and two folds.

* * * * *